US006955150B2

(12) United States Patent
Moss

(10) Patent No.: US 6,955,150 B2
(45) Date of Patent: Oct. 18, 2005

(54) METHOD AND APPARATUS FOR EFFICIENTLY COOLING MOTORCYCLE ENGINES

(76) Inventor: Marlon Euyvon Moss, 4030 Anzar Rd., Aromas, CA (US) 95004

( * ) Notice: Subject to any disclaimer, the term of this patent is extended or adjusted under 35 U.S.C. 154(b) by 0 days.

(21) Appl. No.: 10/646,878

(22) Filed: Aug. 21, 2003

(65) Prior Publication Data

US 2005/0039719 A1 Feb. 24, 2005

(51) Int. Cl.[7] ..... F01M 5/00
(52) U.S. Cl. ..... 123/196 AB; 180/229
(58) Field of Search ..... 123/196 R, 196 AB, 123/196 A, 196 CP, 41.33, 41.49, 41.48; 180/229

(56) References Cited

U.S. PATENT DOCUMENTS 4,027,643 A * 6/1977 Feenan et al. ..... 123/196 AB
4,257,554 A * 3/1981 Willingham ..... 236/35
5,701,853 A * 12/1997 Takahashi ..... 123/41.33
6,076,488 A * 6/2000 Yamagishi ..... 123/41.12
6,772,824 B1 * 8/2004 Tsuruta ..... 165/41

* cited by examiner

*Primary Examiner*—Henry C. Yuen
*Assistant Examiner*—Hyder Ali
(74) *Attorney, Agent, or Firm*—Donald R. Boys; Central Coast Patent Agency, Inc.

(57) ABSTRACT

A method for managing oil temperature for a vehicle engine comprises the steps of (a) determining a preferred temperature window for oil in operation of the vehicle, comprising a first, lower temperature, and a second, higher temperature; (b) pumping oil from the vehicle engine to a control valve controlling oil passage into a radiator, and bypassing the radiator via a by-pass passage in the control valve more than seventy-percent of the oil to return to the vehicle engine without passing through the radiator upon cold start-up; (c) closing the bypass passage at the first oil temperature, forcing all oil entering the control valve to pass through he radiator before returning to the vehicle engine; (d) starting a forced-air fan at the second temperature to urge ambient air through air passages of the radiator, thereby enhancing ability of the radiator to cool the oil passing through.

19 Claims, 7 Drawing Sheets

701

| Oil Temperature (F) (+ / - 2%) | Component Operation |
|---|---|
| Ambient - 170 | By-pass valve normally OPEN, 90% oilflow by-pass to reservoir |
| 170 - 180 | By-pass valve begins to CLOSE |
| 180+ | By-pass valve fully CLOSED, 100% oilflow to oil cooler |
| 210+ | Thermostat switch CLOSED, oil cooler fan ON |
| 190 | Thermostat switch OPEN, oil cooler fan OFF |

*Fig. 7*

METHOD AND APPARATUS FOR EFFICIENTLY COOLING MOTORCYCLE ENGINES

FIELD OF THE INVENTION

The present invention is related to motorcycles, and pertains more particularly to oil cooling for air-cooled and other motorcycle engines.

BACKGROUND OF THE INVENTION

Many types of motorcycles exist which utilize a variety of engine types and operating temperature regulating apparatus and methods. Some motorcycles employ water cooling systems through the use of radiators and water passages within the engine block and other engine or transmission components. By far the most common type of motorcycle engine today, however, is an air-cooled engine comprising a lightweight aluminum engine block and cooling fins integrated around cylinders to dissipate accumulated heat from the engine generated from combustion and component friction within the engine.

Notably, motorcycles manufactured by Harley-Davidson Motorcycle Company of Milwaukee, Wis. have large displacement, air-cooled four stroke engines which, as is true for the vast majority of motorcycle engines, comprise an engine lubrication system comprising a least one oil pump which circulates oil through the engine for lubricating the components thereof, and for carrying away the accumulated heat of combustion and friction generated within the engine during operation.

Such large displacement, air-cooled four-stroke engines of current art, such as those manufactured by Harley-Davidson Motorcycle Company, typically utilize two different types of oil pumps for circulating oil through the lubrication system, namely a scavenge pump and a lubricating pump. The scavenge pump draws oil from the crank case area, then returns the oil to the oil reservoir, and the lubrication pump is utilized for circulating oil through the remainder of the system. To maintain adequate oil flow the scavenge pump is typically designed to operate at approximately 120 percent of the pump capacity of the lubricating pump, which is the supply pump of the system.

It is well-known in the art that, for such large displacement, air-cooled engines as described above, it is important that the operating temperature of the engine and lubricating oil reach a certain temperature after start-up from a cold start before operating the motorcycle on the road. Lubricating engine oil at ambient temperature has higher viscosity than at engine operating temperature, and because of this heavier consistency of cold oil, it does not flow easily through small oil passages within the engine block or oil cooling system. Further, upon cold start up, lubricating oil from the crank case takes a finite time to reach the components within the engine, and until such time after startup, cold metal-to-metal contact may occur between components within the engine, known as "hammer effect" in the art.

During operation of such a large displacement, air-cooled motorcycle as described above, the temperature range of the engine and therefore the lubricating oil may vary greatly depending on the circumstances of operation. For example, if the running motorcycle is stopped at a stop light or in traffic, or for any other reason during engine operation, cooling air is not adequately flowing around the finned cylinders and other portions of the engine, the temperature of the engine and lubricating oil may rise quickly to the point of oil thermal breakdown temperature, which quickly accelerates engine component friction and wear, significantly shortening the life of the engine.

It has been empirically determined by testing in the industry that the recommended minimum temperature for the lubricating oil for safely operating and maintaining engine life in such large displacement air-cooled four stroke engines as described above, should be at least 100 degrees Fahrenheit before operating the motorcycle. Empirical testing has also determined that the oil temperature should reach at least 100 degrees Fahrenheit before significantly raising the engine rpm and adding significant stress to the engine components, and after complete warm up and during operation of the motorcycle, a typical recommended temperature range for the oil is between approximately 170 degrees and 210 degrees Fahrenheit.

It is therefore desirable to maintain the oil operating temperature within the recommended range during all of the operating time of the motorcycle. It is also therefore desirable to be able to quickly raise the oil temperature upon start-up from a cold start, so as to shorten the potential time of "hammer effect" of cold metal-to-metal engine component contact.

Many motorcycles such as those described above manufactured by Harley-Davidson Motorcycle Company, for example, utilize oil cooling systems for attempting to maintain oil temperature. In such systems the lubricating oil is pumped from the crank case by a scavenge pump, first circulating through an oil filter, and is then diverted to a simple radiator-type oil cooler for cooling, and the cooled oil then circulates back to the reservoir.

In such systems, the oil cooler is typically mounted horizontally to the down tubes at the front of the frame of the motorcycle, transverse to the direction of travel of the motorcycle. Such an arrangement, however, has significant drawbacks in that oil cooling unit, for example, by being mounted unprotected on the front of the frame of the motorcycle, is exposed to damage from rocks, tar, and other road debris that may be kicked by the front tire of the motorcycle during operation, or by other vehicles sharing the road with the motorcycle. Further, depending on speed of travel of the motorcycle, conventional oil coolers mounted in such a way are not subjected to as much of the air circulation as may be required, due to the air flowing over a motorcycle traveling forward tending to divert under, over and around the front of the engine.

Another drawback in current art oil coolers and diverter apparatus is that, as equal amounts of oil are diverted to the oil cooler and by-passed back to the reservoir, the relatively excessive amount of oil pumped through the oil cooler at cold startup extends the period of time required for reaching the recommended operating temperature of the oil. The inventor has discovered that it is desirable, particularly at cold startup, to by-pass as much of the oil as possible back to the oil reservoir, provided that there remains at least a small portion of the total flow out of the oil filter diverted sufficient for dissipating condensation from within the crank case at cold start up, as typically happens with air-cooled aluminum block engines such as described.

It is therefore desirable to provide an oil cooling unit, system and method which overcomes all of several drawbacks described above for such current art oil cooling systems. An improved oil cooling unit, system and method is herein provided by the inventor, and is described below in enabling detail.

SUMMARY OF THE INVENTION

In a preferred embodiment of the present invention an oil-cooling system for lubricating oil of a vehicle engine is provided, the system comprising a radiator having an oil inlet and an oil outlet communicating with internal passages of the radiator, an electrically-operated fan interfaced to the radiator in a manner to urge air through the radiator over the internal passages, the fan turned on and off by a temperature sensitive switch sensing oil temperature, a valve having a first inlet, a first passage through the valve through a first chamber to a first outlet, a second inlet, a second passage through the valve through a second chamber to a second outlet, and a translatable valve closure element controlling a passage from the first chamber to the second chamber, and a temperature-operated translation element positioned in the first chamber in the path of oil entering the valve through the first inlet, and connected to the translatable valve element in a manner to progressively close the passage from the first chamber to the second chamber at higher oil temperature, and to progressively open the passage from the first chamber to the second chamber at lower oil temperature. The system is characterized in that, below a first oil temperature the passage between the first and the second chamber remains open allowing oil coming in the first inlet to bypass the radiator to the second outlet, the passage closes gradually as oil temperature rises, closes completely at the first oil temperature so that all oil coming in the first inlet must pass through the radiator and none may bypass, and in that the temperature-sensitive switch operating the fan causes the fan to start at a second oil temperature higher than the first oil temperature, enhancing ability of the radiator to cool the oil.

In some preferred embodiments there is a volume between the fan and the radiator, providing a positive pressure chamber for air prior to passing over the radiator internal passages, such that air urged by the fan into the positive pressure chamber is distributed evenly over the internal oil passages. Also in some preferred embodiments the radiator comprises a stack-tube design.

In some embodiments the translatable valve closure element is preloaded in both translation directions by springs of differing spring rate, thereby providing a controlled force bias keeping the valve open at oil temperatures below the first temperature. Also in some embodiments the temperature-operated translation element comprises a volume of temperature-sensitive wax that expands with increasing temperature.

In some embodiments, at maximum opening of the passage between the first and second chamber, the opening allows at least seventy percent of oil from the vehicle engine to bypass the radiator and return to the vehicle engine. In some other embodiments, at maximum opening of the passage between the first and second chamber, the opening allows at least ninety percent of oil from the vehicle engine to bypass the radiator and return to the vehicle engine. The invention is especially suited for cooling oil for motorcycle engines. In some cases there is a shroud protecting the radiator when mounted on a vehicle. Also in some cases the system further comprises a mounting plate, one or more downtube mounting elements, and connectors and conduits compatible with a motorcycle, thereby providing an aftermarket kit for integrating the system to a motorcycle.

In another aspect of the invention a method for managing oil temperature for a vehicle engine is provided, comprising the steps of (a) determining a preferred temperature window for oil in operation of the vehicle, comprising a first, lower temperature, and a second, higher temperature; (b) pumping oil from the vehicle engine to a control valve controlling oil passage into a radiator, and bypassing the radiator via a by-pass passage in the control valve more than seventy-percent of the oil to return to the vehicle engine without passing through the radiator upon cold start-up; (c) closing the bypass passage at the first oil temperature, forcing all oil entering the control valve to pass through he radiator before returning to the vehicle engine; (d) starting a forced-air fan at the second temperature to urge ambient air through air passages of the radiator, thereby enhancing ability of the radiator to cool the oil passing though; and (e) as oil temperature falls, opening the bypass passage again at the first temperature.

12. The method of claim 11 wherein a volume is provided between the fan and the radiator, providing a positive pressure chamber for air prior to passing over the radiator internal passages, such that air urged by the fan into the positive pressure chamber is distributed evenly over the internal oil passages.

In some preferred embodiments the radiator comprises a stack-tube design, and in some preferred embodiments the translatable valve closure element is preloaded in both translation directions by springs of differing spring rate, thereby providing a controlled force bias keeping the valve open at oil temperatures below the first temperature. In other preferred embodiments the temperature-operated translation element comprises a volume of temperature-sensitive wax that expands with increasing temperature.

In some embodiments, at maximum opening of the passage between the first and second chamber, the opening allows at least seventy percent of oil from the vehicle engine to bypass the radiator and return to the vehicle engine. In other embodiments, at maximum opening of the passage between the first and second chamber, the opening allows at least ninety percent of oil from the vehicle engine to bypass the radiator and return to the vehicle engine. The method is particularly adaptable a motorcycle engine.

In some embodiments a shroud protects the radiator when mounted on a vehicle. Further, in some embodiments there is a mounting plate, one or more downtube mounting elements, and connectors and conduits compatible with a motorcycle, thereby providing an aftermarket kit for integrating the system to a motorcycle.

BRIEF DESCRIPTION OF THE DRAWING FIGURES

FIG. 1*a* is a front elevation view of a mounting plate for an oil cooling unit according to an embodiment of the present invention.

FIG. 1*b* is a side elevation view of the mounting plate of FIG. 1*a*.

FIG. 2*a* is a perspective rear view of an oil cooling unit according to an embodiment of the present invention.

FIG. 2*b* is a perspective front view of the oil cooling unit of FIG. 2*a*.

FIG. 7 is a simplified chart illustrating oil cooling system component operation relative to oil temperature in accordance with an embodiment of the present invention.

DESCRIPTION OF THE PREFERRED EMBODIMENTS

Figure 1B:
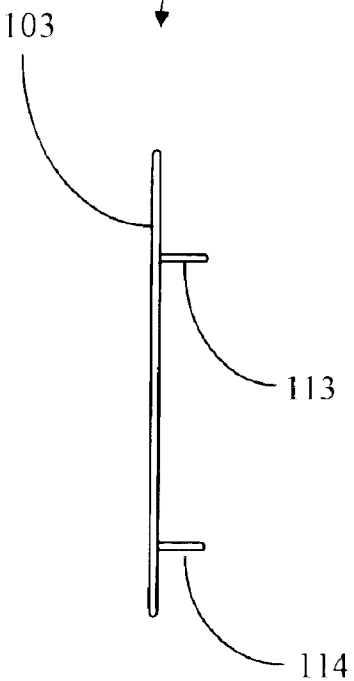
Figure 1A:
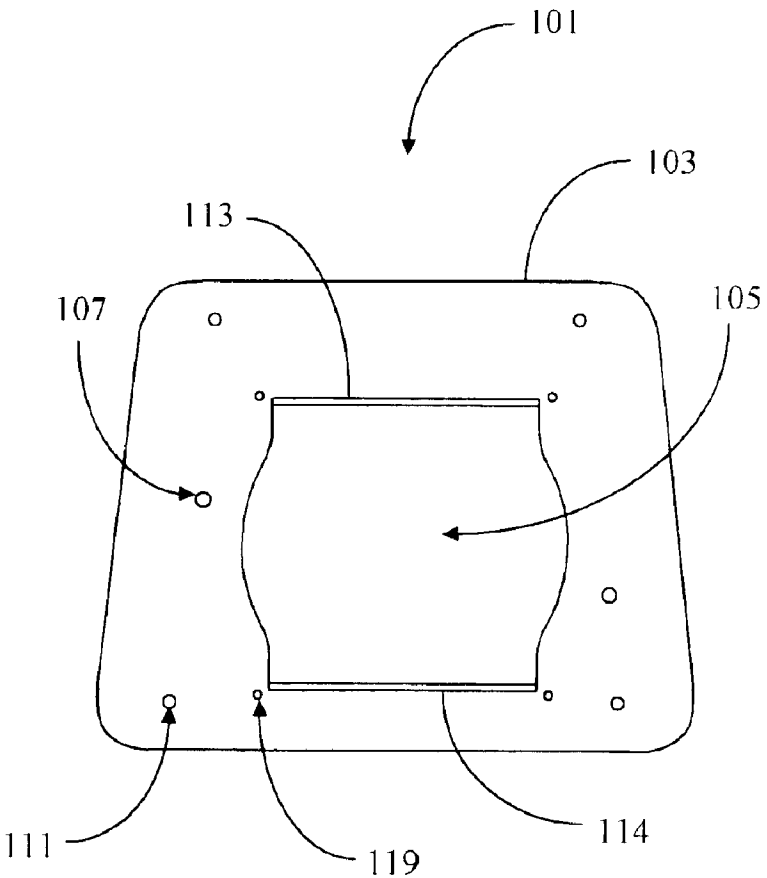

Referring now to FIG. 1*a*, the inventor first illustrates a mounting plate 101 provided for mounting an improved oil cooling unit to the front of a motorcycle. Plate 101 is in this example roughly trapezoidal in shape, the nonparallel sides extending upward from the bottom edge to form a smaller upper edge, and has four rounded corners. Plate 101 is designed for mounting to the front frame members of a motorcycle frame, particularly a pair of down tubes at the front of the frame, and the non-parallel sides are accordingly angled to align approximately with the angle between the pair of down tubes of the motorcycle frame. Since such an angle may vary from motorcycle model to model, and it is desirable for the edges of the plate to align with the edges of the frame when the plate is attached to the frame, the angle of the non-parallel sides of plate 101 may vary accordingly in alternative embodiments, and is therefore not particularly important in the scope and spirit of the present invention.

Plate 101 comprises a body 103 preferably manufactured of strong, lightweight material resistant to bending and warping, such as sheet metal, aluminum plate, or in some alternative embodiments plasticized or fiberglass materials, or some other similar material of suitable properties. It can be seen in FIG. 1*b* that body 103 of plate 101 is substantially thin compared to it's width, and it is desirable to utilize a material in the manufacture of plate 101 which allows for it's thickness to be minimal with maximum resistance to bending or warping.

Plate 101 is provided with a large opening 105 through body 103 for the purpose of enabling air circulation through body 103, when the improved air cooling unit of the present invention is mounted thereupon, as is subsequently described below. Opening 105 in this example has rounded sides extending upward from a straight bottom edge to a straight top edge, and the width of the opening is approximately equal to it's height, in this embodiment about 4½ inches.

A series of through-holes 111 are provided through body 103 near each corner, facilitating attachment of plate 101 to the motorcycle frame. A pair of through-holes 107, one located on each side of opening 105, and a series of four through-holes 119, one located near each corner of opening 105, enable attachment of the improved oil cooling unit assembly of the present invention, utilizing known attachment means, as is further described below.

A portion of body 103 located at each top and bottom edge of opening 105, protrudes outwardly from body 103 in this example, these being upper guard 113 extending from the upper edge of opening 105, and lower guard 114 extending outwardly from the lower edge of opening 105, both to a distance of approximately ¾ inch. The upper and lower guards have both the purpose of providing a conduit for maximum air circulation through oil cooler 203 when mounted, as well as providing protection to the cooling passages within oil cooler 203 from outside debris.

FIG. 1*b* is a side elevation view of mounting plate 101 of FIG. 1*a*, which better illustrates the thickness of body 103, in this embodiment approximately ⅛ inch. Upper guard 113 and lower guard 114 are seen in this view extending outwardly from the surface of body 103, as described for FIG. 1*a*. Body 103 in this embodiment has a vertical height of approximately 6¾ inches, and a width of approximately 8½ inches as it's base, and approximately 7 inches at it's height. As mentioned, however, all of these dimensions may vary in all embodiments, at least partly in accordance with the dimensions between the motorcycle frame members to which plate 101 is attached, and those of the improved oil cooling unit which attaches thereto as described below.

Figure 2B:
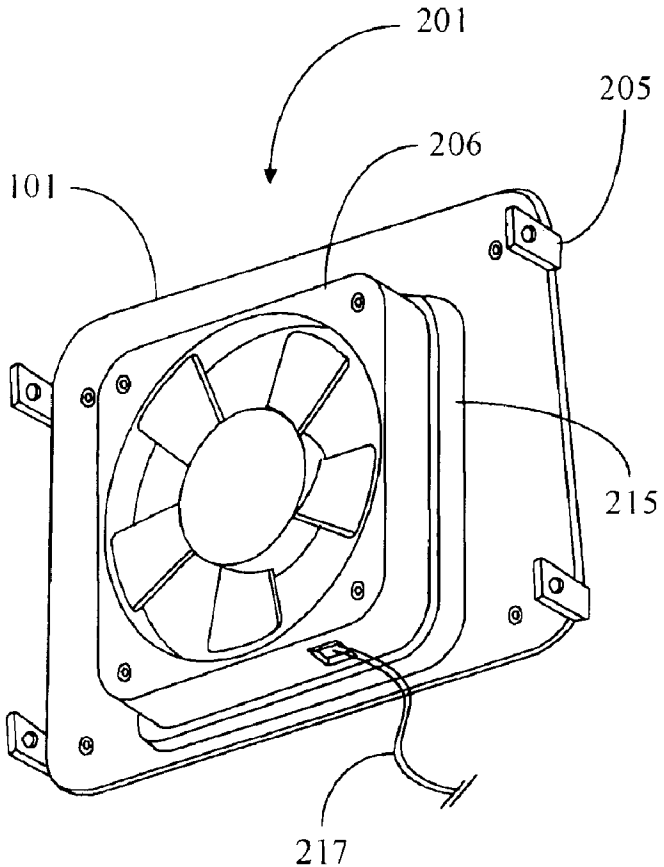
Figure 2A:
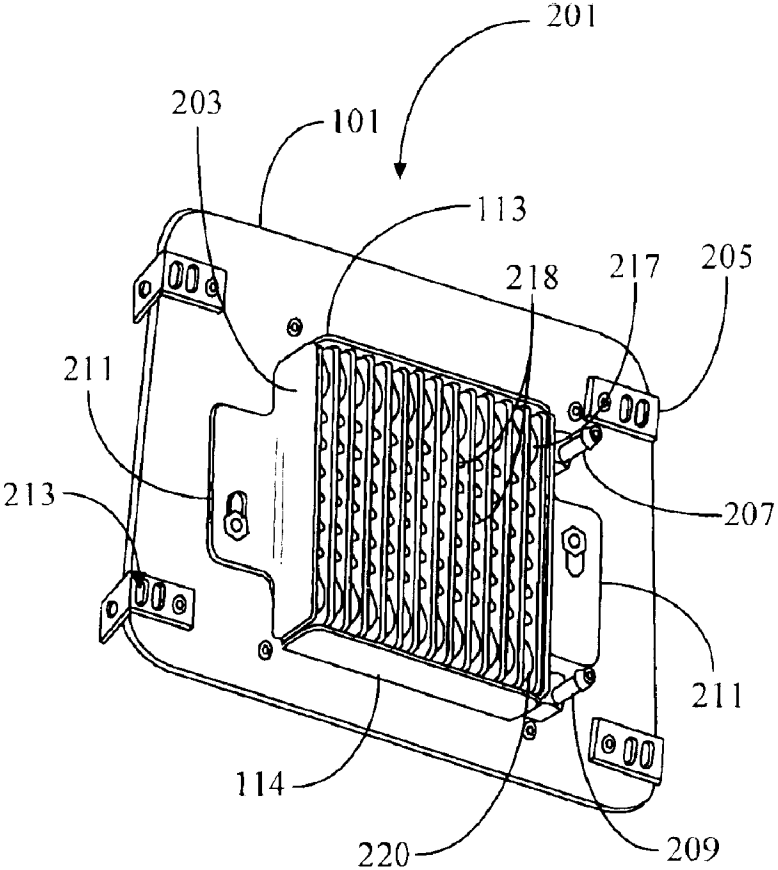

FIGS. 2*a* and 2*b* are perspective views of the rear and front of an improved oil cooling unit 201 according to a preferred embodiment of the present invention. Oil cooling unit 201 is provided as part of an improved oil cooling system and method which overcomes all of the drawbacks of current art oil cooling systems as described previously in the background section.

Oil cooling unit 201 comprises the main components of mounting plate 101 of FIG. 1*a*, and improved oil cooler radiator 203, and, as shown in FIG. 2*b*, a cooling fan assembly mounted to the rear side of plate 101, and a plurality of mounting brackets 205 for attaching plate 101 to the front of the motorcycle frame.

Referring now back to FIG. 2*a*, oil cooling unit 201 is provided with an improved oil cooler radiator 203, adapted for mounting to the surface of plate 101 utilizing a pair of mounting flanges 211, one on either side of oil cooler 203, through which mounting holes extend which align with holes 107 of plate 101. Standard fasteners are shown attaching oil cooler 203 to plate 101. Each mounting flange 211 also has a portion that extends upward from the surface of plate 101, along the sides of oil cooler 203, to a distance approximately equal to that of upper guard 113 and lower guard 114. The side upwardly-extending portions of mounting flanges 211, together with upper guard 113 and lower guard 114, form a protective shield which extends around the circumference of oil cooler 203, protecting the cooling fins and tubes internal to oil cooler 203 from damaging debris which may be possibly kicked up from the road during motorcycle operation.

Conventional oil coolers of current art as described previously, in addition to the several drawbacks outlined above, lack sufficient oil cooling capacity due to the inherent nature of their design. Specifically, such conventional oil coolers have an inlet leading to a series of tubes running within the framework of the oil cooler, leading then to an outlet. Heat is drawn from the oil passing through the tubes of the oil cooler by way of cooling fins welded or otherwise formed on the outer surface of the oil passage tubes. Such an oil cooler configuration and arrangement is known in the art as a tube-fin design, and is limited in the capacity for drawing heat from the oil passing through tubes, due to its inherent design.

Notably, motorcycle engines of motorcycles manufactured by Harley-Davidson Motorcycle Company, when outfitted with oil cooling systems, typically utilize simple oil coolers of such simple tube-fin design, which are somewhat large in overall dimension, approximately 3 inches tall by 8 inches wide by 1¼ inches deep, and which are usually mounted directly across the front of the engine or frame utilizing standard mounting brackets. As mentioned previously, however, such a mounting arrangement provides for no protection of the oil cooler itself from road debris or other road hazards inherent when operating a motorcycle, and its close proximity to the engine further curtails the oil cooling capacity of the oil cooler when the engine is hot.

Through empirical testing, the inventor has determined that a much smaller and more compact oil cooler may be utilized by increasing the oil cooling capacity of the oil cooler itself, and integrating the improved oil cooler into the oil cooling unit and system as described herein. For this purpose, the inventor utilizes a new and improved oil passage cooling system for oil cooler 203. In this embodiment, although not shown in great detail in the present illustrations, cooler 203 utilizes an improved cooling system for the oil passages of cooler 203, known in the art as a stack-tube configuration, but improved upon by the inventor for the specific applications.

As mentioned above, in a tube-fin configuration, the oil to be cooled flows through tubes which have fins attach thereto which draw heat from the oil, and dissipate the heat to the surrounding circulating air by radiation and convection. The present invention, however, utilizes a stack-tube configuration, wherein the tubes are multilayered such that cooling air circulating through the first layer of tubes directly meets, and tends to flow around a layer of tubes directly behind the first layer. Further, in the stack-tube configuration utilized for oil cooler 203, not only does oil flow through each tube, but also flows through the "cooling fins", which are actually bulbous extensions of the tubes themselves. Oil flowing through said bulbous extensions tends to accumulate somewhat as it flows thorough, allowing much more heat to be drawn from the oil due to the greatly increased surface area of each fin oil passage, and the extended time in which the oil spends in the bulbous cooling "fins" as it flows thorough. Further, each separate tube is also connected to its adjacent tube by means of the bulbous fins, and oil within is therefore enabled to pass between tubes, in addition to through each tube, further enhancing cooling capacity of the oil cooler.

Such a configuration enables the use of a much smaller, compact oil cooler which is more efficient in oil cooling capacity, and more economically manufactured than conventional motorcycle oil coolers of current art. Oil cooler 203 is approximately 4 inches wide by 4 inches high by ¾ inches deep, which is a small percentage of the overall dimensions of a conventional motorcycle oil cooler as referenced previously.

Oil cooler 203 has an inlet 207 for receiving oil to be cooled, which is pumped from the engine through the oil filter of the motorcycle engine. Inlet 207 allows incoming oil into a large horizontal upper passage 216, down through a series of vertical interconnected cooling fins 217, each of which have bulbous cooling extensions 218 as described above, and into a large lower passage 220, and finally to outlet 209.

Oil cooling unit 201 is adapted for mounting to the down tubes of the front of the frame of the motorcycle, transversely to the direction of travel of the motorcycle, with oil cooler 203 facing the motorcycle engine. Mounting brackets 205 are provided for this purpose, and are fixedly attached to plate 101 near each corner. Mounting brackets 205 are preferably manufactured of metal but may be manufactured of a variety of strong, lightweight materials in various embodiments. Mounting brackets 205 each have a pair of elongated through holes 213 arranged on brackets 205 such that a bridge is formed between them, allowing passage of an unsecured end of a standard hose clamp which may is used to secure brackets 205 to the down tubes of the frame of the motorcycle. The aforementioned mounting method is better illustrated in subsequent disclosure below.

To provide additional cooling for oil according to this embodiment of the present invention, oil cooling unit 201 is provided with a cooling fan 206, mountable to the front side of mounting plate 101 (away from the engine direction), which provides substantial additional cooling of the oil when required, automatically, and according to oil temperature. Fan 206 is mounted to plate 101 utilizing through holes 119 (FIG. 1*a*) and standard fasteners, and is a commercially available cooling fan well known in the industry. In the preferred embodiment illustrated fan 206 is of a standard size, and has an opening with a circumference substantially equal to that of opening 105 of plate 101 (FIG. 1*a*), for the purpose of maximizing air flow through plate 101 during operation of the fan. Fan 206 in a preferred embodiment has a circulation capacity of approximately 150 cubic feet per minute (CFM), at approximately 1.7 meters of air pressure. In alternative embodiments, however, this air flow capacity may vary depending upon the application and oil cooling capacity required.

Oil cooling unit 201 is further provided with a spacer 215 disposed between fan 206 and plate 101, having a depth approximately ½ that of fan 206, and an outside circumference slightly greater, approximately ¼ inch on each side. Spacer 215 effectively seals the opposing surfaces of fan 206 and plate 101, has an opening (not shown) having dimensions substantially equal to that of fan 206 providing air passage, and is provided in this embodiment also for creating a positive air pressure chamber during operation of fan 206. In such a way, during operation of the fan, air is collected in a plenum ahead of the radiator at an increased pressure, before passing through oil cooler radiator 203, which provides for more even distribution of cooling air over the cooling elements of oil cooler radiator 203 during operation.

Fan 206 receives power for operation via power lead 217 which leads to a power source. In a preferred embodiment as illustrated herein, fan 206 is automatically operated by means of a normally-open thermostatically controlled electrical switch which senses oil temperature and either remains open or closes accordingly to operate the fan, depending on the oil temperature before the oil goes through the cooler. Further illustration and disclosure is provided below pertaining to the operation of the cooling fan and thermostatically controlled fan operating switch.

As mentioned in the background section, some oil cooling systems of current art may utilize a simple diverter unit disposed between the oil filter and oil cooler for bypassing all or a portion of the circulating oil from the oil filter away from the oil cooler, bypassing all or a portion directly back to the oil reservoir. Also, it is desirable to be able to regulate the temperature of the motorcycle engine's lubricating oil after start-up from a cold start and during operation to achieve optimum oil viscosity which occurs in the recommended operating temperature range, in the least amount of time, and maintaining the recommended oil operating temperature within the range specified by the manufacturer during extended operation of the motorcycle in a variety of extreme conditions.

Current art diverter apparatus used in oil cooling systems for large displacement, air-cooled four stroke engines, such as those for motorcycle's manufactured by Harley-Davidson Motorcycle Company, as described above, typically have a total flow capacity of approximately 2.5 gallons per minute (GPM), and when activated, divert approximately 50 percent of the total oil flow out of the oil filter to the oil cooler, bypassing the remaining 50 percent back to the reservoir. In other applications the diverter apparatus in a normally-open condition either diverts 100 percent of the oil flow back to the reservoir, such as during start-up, or, when the engine or oil reaches a certain temperature, diverts 100 percent of the oil flow through the oil cooler. Such current art diverters have an internal thermostatically controlled valve approximately ¼ inch in diameter, and having a total travel distance between lands within the diverter apparatus of approximately 1/16 inch. The oil by-pass capability is therefore limited in such diverter valve apparatus of current art.

It has been determined, however, through empirical testing by the inventor, that, particularly under extreme conditions during operation of the motorcycle after warm up, diverting equal amounts of the total oil flow to the cooler and reservoir, or either all or none of the oil flow, as in current art, is insufficient for ensuring optimum oil temperature for quick startup and oil and engine protection during operation of the motorcycle.

To provide for automatically controlling and regulating the oil flow through the oil cooling system in a much more effective and efficient manner, an improved by-pass valve is provided by the inventor, which, when used in conjunction with other elements of the oil cooling unit and system described herein, overcomes all of the drawbacks mentioned above in oil diverters of current art systems.

Figure 3:
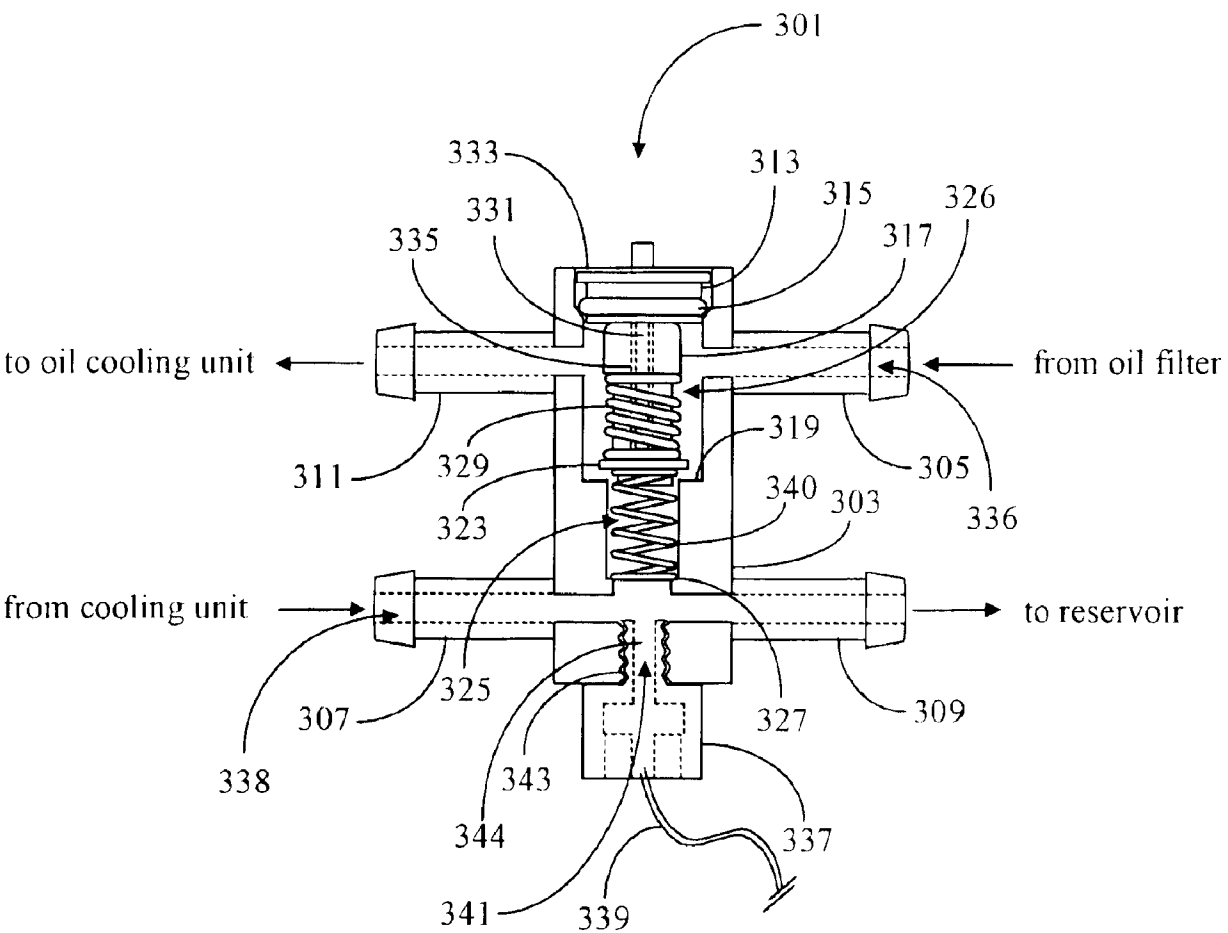
FIG. 3 is an elevation view of an improved oil cooler by-pass valve according to an embodiment of the present invention.

Referring now to FIG. 3, an elevation view is given of a unique and improved oil cooler by-pass valve according to an embodiment of the present invention. By-pass valve 301 is provided for automatically regulating oil flow to the oil cooler depending on oil and engine operating temperature, to achieve and maintain optimum oil viscosity and recommended temperature range after cold startup and during motorcycle operation. By-pass valve 301 is of a type known in the industry in which a thermally responsive element within the valve actuates a closure element to allow oil to flow to an oil cooler. By-pass valve 301, however, has been modified and adapted to be utilized with the oil cooling unit of the present invention, to allow for more effective and efficient oil temperature regulation under all operating conditions.

By-pass valve 301 has a main body 303 comprising an internal chamber 326 having a land (shoulder) 319 at the bottom of the chamber, and directly below chamber 326, a smaller chamber 325 opens to chamber 326, and also has a small land (shoulder) 327 at the bottom of the chamber. Land 319 functions as a valve seat for sealing off chamber 326 from chamber 325, while land 327 functions as a spring stop.

By-pass valve 301 has a total of four nozzles providing inlets and outlets connectable to oil passage conduits for oil flowing to and from by-pass valve 301. In the embodiment illustrated, inlet 305 and outlet 311 are shown as the upper conduits. Inlet 305 provides oil passage into chamber 326, provided typically from the output of an oil filter (not shown) of an engine. An oil passage conduit (not shown) connects the output of the oil filter to inlet 305. A passage 336 extends through the inlet 305, into and through chamber 326, and then passing out outlet 311, enabling oil flow to flow into and out of chamber 326.

The lower nozzles of by-pass valve 301 are inlet 307 and outlet 309, and also comprise a similar passage 338 providing a conduit enabling oil flow from the oil cooler, through by-pass valve 301, and out to the oil reservoir. Passage 338 also opens into chamber 325 directly above, such that oil may be allowed to flow from passage 336, down through chamber 327 and chamber 325, and into passage 338. Oil passage conduits (not shown) are typically connected between outlet 311 and the inlet of the oil cooler, inlet 307 and the outlet of an oil cooler, and outlet 309 to the inlet of an oil reservoir.

By-pass valve 301 also comprises a valve actuating mechanism which is similar to those utilized in by-pass valves of current art, with the exception of certain key differences which enable by-pass valve 301 to operate in a much more efficient manner. The valve actuating mechanism of by-pass valve 301 utilizes a thermally responsive element which expands to urge an actuating element against a compression spring which urges against a valve seat and thereby causes oil to flow through the oil cooler. The thermally reactive element comprises a special wax-filled chamber 335 within a gland 317, and an expansion rod 331 within wax-filled chamber 335. Expansion of the special wax within chamber 335 caused by increased temperature of oil flowing around gland 317, causes gland 317 to urge downward against compression spring 329, and the increased tension of spring 329 thereby urges valve 323 downward towards land 319 against resistance from spring 340. As oil temperature and wax expansion increases, valve 323 is further urged downward by gland 317 until seated on land 319, thereby sealing chamber 326 from lower chamber 325.

Following the discussion above, when the oil is cold the valve element 323 is retracted and oil can freely flow from chamber 326 to chamber 325, as well as to outlet 311 and then through the oil cooler. As the temperature increases more oil is caused to go through the cooler, and less through the bypass route. Finally, at a specific temperature the valve is closed, and all oil goes through the cooler.

The valve actuating mechanism described above for by-pass valve 301 is secured within body 303 utilizing an aluminum seal 313, secured with a standard circlip 333, and sealed with O-ring 315 to oil passage through seal 313. A compression spring 329 is disposed between valve 323, and seats within an adapted bottom portion of gland 317, preventing lateral movement of spring 329.

The valve actuating mechanism illustrated in FIG. 3 is shown in the normally open position, which is the preset condition of by-pass valve 301. The thermally-responsive valve actuator mechanism of by-pass valve 301 is held in the normally open position by compression spring 340 disposed between the bottom of valve 323 and land 327, the spring pressure urging valve 323 upward. The dual action of springs 329 and 340, with the springs selected for spring rate and amount of precompression, allow for ability to easily move valve element 323.

In a departure from current art, by-pass valve 301 has been adapted in several ways to better regulate oil temperature in a variety of conditions including cold startup and extreme operating heat, such that optimum oil viscosity and temperature range is maintained, which greatly increases oil performance and ultimately engine life.

Specifically, as mentioned above, current art by-pass apparatus used in conventional oil cooling systems typically have a total flow capacity limit of approximately 2.5 gallons per minute (GPM), and when closed, may divert approximately 50 percent of the total oil flow out of the oil filter to the oil cooler, bypassing the remaining 50 percent back to the reservoir, or some may divert 100 percent of the oil flow back to the reservoir, such as during start-up, or, when the engine or oil reaches a certain temperature, diverting 100 percent of the oil flow through the oil cooler. Such current art diverter apparatus have an internal thermostatically controlled valve approximately about ¼ inch in diameter, and having a total travel distance between lands within the apparatus of approximately 1/16 inch. The oil by-pass capability is therefore limited in such diverter valve apparatus of current art.

The valve actuating mechanism within by-pass valve 301 of FIG. 3 is shown in the normally open position, that is, compression spring 340 urges valve 323 upward above land 319, creating a space between land 319 and the bottom of valve element 323, which enables oil to flow from chamber 326 down to chamber 325. In this position gland 317 is urged to the farthest upper position limited by aluminum seal 313, by the compressive force of spring 329 disposed between space or 323 and gland 317.

Gland 317 is positioned to directly intersect the oil flow through passage 336 between inlet 305 and outlet 311. Gland 317 is of special design and circumference such that in its position between inlet 305 and outlet 307 during the normally open valve actuator mechanism position, approximately 10 percent of the total flow rate from the oil filter is automatically and at a consistent level, diverted out through outlet 311. Such large displacement, air-cooled four stroke engines as described herein typically utilize an aluminum engine block, and it is well-known that water condensation within the crank case, or oil reservoir, after a hot engine has cooled is undesirable, but a factor that must be dealt with. It has been determined by the inventor that, upon startup from a cold start, 10 percent of the total oil flow rate from the oil cooler is sufficient for carrying away air and moisture from within the crank case upon startup and by bringing the oil to a temperature of at least 180 degrees F., for dissipation outside of the engine through various means.

In the normally open position the valve actuator mechanism of by-pass valve 301, at cold startup, thereby allows oil flow from the oil filter through inlet 305, wherein the flowing oil tends to flow around gland 317 within chamber 326. Approximately 10 percent of the total oil flow into by-pass valve 301 is thereby diverted to outlet 311 and out to the inlet for an oil cooling unit. In this open position the remaining 90 percent of oil flow enters down into and through chambers 326, and chamber 325 since valve 323 is unseated from land 319 in this position, and finally to passage 338 where it merges with the 10 percent flow returning from oil cooling unit via inlet 307, all of which is returned to the reservoir, but only 10 percent of which has been cooled by the oil cooling unit. In this manner the dual benefit is provided of significantly reducing the time period required for warming the engine oil to operating temperature after a cold startup, and minimizing a condition known in the industry as airlock, whereby air is left in the crankcase during engine cooling, containing moisture which is not adequately expressed from the engine very quickly after startup.

It is emphasized that the descriptions herein are exemplary, and the percentages and other characteristics described are not limiting to the invention. In some cases more than 90 percent of the oil will be bypassed in the situation just described above, and in some other cases less. The inventor believes that to provide an adequate run-up sequence from a cold-start that at least 70 percent of the oil should be by-passed.

As oil temperature increases during operation of the engine of the motorcycle, the specialized wax within chamber 335 expands, urging gland 317 downward, compressing spring 329, thereby urging valve 323 downward towards land 319, which is a valve seat for valve element 323. As the valve actuating mechanism begins to close as the oil temperature rises the flow ratio between supply passage 336 and return passage 338 begins to change quickly and dramatically, until valve 323 is urged securely into land 319, thereby sealing chamber 325 from oil flow within chamber 326 and passage 336, and causing all oil from the filter to pass through the oil cooler.

With valve element 323 securely seated oil can no longer flow into chamber 325 and thereby into passage 338, so 100 percent of the oil flow entering valve 301 from an oil filter output is now diverted directly to an oil cooling unit via output 311, thereby cooling 100 percent of the oil before it is circulated out of by-pass valve 301 back to the oil reservoir of the engine.

As mentioned previously the valve actuating mechanism of by-pass valve 301 has modifications which greatly enhance the flow control and capacity through by-pass valve 301. Specifically, valve element 323 and the openings of chambers 326 and 325 are significantly larger than those of by-pass valves of current art. For example, valves and valve actuating mechanisms of by-pass valve of current art are typically approximately ¼ inch in diameter, and the valve seat in such a by-pass valve is slightly smaller. Further, the travel distance of current valves between the valve seat and the uppermost valve position in the fully open condition is approximately 1/16 inch.

Valve element 323 of by-pass valve 301, on the other hand, is significantly larger than those of current art, up to ⅝ inch in diameter in a preferred embodiment, and land 327, which functions as the valve seat for valve 323, is only slightly smaller in diameter, and the travel distance of valve 323 between the normally open position and land 327 is significantly greater than that of current by-pass valve actuating apparatus, preferably at least ⅛ inch, thereby providing an oil passage significantly larger than current art valves, which significantly increases oil bypass flow rate comparative to current models.

Referring now back to FIG. 2*b*, a fan 206 is provided which enhances oil cooling for cooling unit 201, fan 206 mountable to the front side of mounting plate 101. Fan 206 receives power for operation via power lead 217 which connects to a power source. In a preferred embodiment as illustrated herein, fan 206 is automatically operated by way of a normally open thermostatically controlled electrical switch which senses oil temperature and either remains open or closes to control the functions of an oil cooling fan, depending on the oil temperature.

Now referring again to FIG. 3, thermostat switch 337 is provided in this embodiment for controlling the on/off condition of cooling fan 206. Switch 337 is a normally open thermostatically controlled electrical switch which is known in the art and commercially available, which is sensitive to the temperature of the oil flowing through passage 338 of by-pass valve 301, and either opens or closes the electrical switch to actuate cooling fan in response to the temperature of the flowing oil. Switch 337 is adapted in this embodiment for attachment to the lower portion of body 303 of by-pass valve 301, utilizing a threaded male portion 344 of switch 337, which is threaded into the female threaded opening 343 formed into the bottom surface of body 303 of by-pass valve 301.

Thermostat switch 337, as is typical in similar temperature-sensitive electrical switches known in the art, closes an electrical circuit utilizing known switch actuation means, when a certain oil temperature threshold is met. Oil passage 338 between inlet 307 and outlet 309 is open to a chamber 341 provided within thermostat 337, enabling switch 337 to sense the temperature of the oil flowing through passage 338, and operate the electrical switch accordingly.

Referring ahead now to FIG. 7, a simplified table 701 is provided illustrating the operation of the valve actuating mechanism of by-pass valve 301 and cooling fan 206, relative to sensed oil temperature in accordance with an embodiment of the present invention. It is noted herein that in the table provided, oil temperature is illustrated in degrees Fahrenheit, and the stated temperatures may vary as much as approximately plus or minus two percent, without changing the associated component operation.

From cold startup, the engine of the motorcycle engine is at ambient temperature, variable depending on the surrounding environment. Regardless of the ambient temperature, however, it can be assumed that the temperature of the engine oil may be the same as, or close to that of the engine, particularly if the motorcycle has not been operated for an extended period of time, etc. It is desirable, therefore, that upon engine startup, the engine oil reach its recommended operating temperature range as quickly as possible in order to achieve the optimum oil viscosity and lubricating and flowing capability.

As illustrated in the simplified table 701, the valve actuating mechanism within by-pass valve 301 remains in the normally open position until the oil temperature reaches 170 degrees Fahrenheit, allowing a 90 percent oil flow by-pass directly back to the reservoir, the remaining 10 percent being diverted by by-pass valve to the oil cooling unit. As previously mentioned, it is desirable to always divert approximately 10 percent of the total oil flow at cold startup to prevent the known condition of air lock.

As the oil temperature exceeds 170 degrees Fahrenheit the valve actuating mechanism of by-pass valve 301 begins to close, and the amount of oil flow diverted to the oil cooling unit compared to that by-passed back to the reservoir increases accordingly. The valve actuating mechanism continues to close as the oil temperature rises towards 180 degrees Fahrenheit.

When the oil temperature flowing through passage 336 of by-pass valve 301 reaches 180 degrees, the valve actuating mechanism of by-pass valve 301 is fully closed, diverting 100 percent of the oil flow into by-pass valve 301, directly to the oil cooling unit.

As mentioned previously, the temperature of the oil in the engine of a motorcycle, unequipped with an embodiment of the present invention, may quickly exceed the recommended operating temperature range due to the motorcycle traveling slowly in heavy traffic or idling at a traffic light, and the resulting lack of air circulation around the engine and oil cooling unit if so equipped. Table 701 illustrates that once the oil temperature reaches 210 degrees Fahrenheit during such extreme operating conditions, additional cooling to oil flowing through the oil cooling unit is provided with an oil cooler fan running, as previously described herein. Thermostat switch 337 (FIG. 3) closes when the oil temperature reaches 210 degrees Fahrenheit, which actuates oil cooling fan 206.

Once activated by the closed thermostat electrical switch 337, cooling fan 206 operates to cool the oil flowing through the oil cooling unit, until the temperature of the oil decreases to 190 degrees Fahrenheit, at which point the thermostatically controlled electrical switch opens, which switches off the cooling fan.

Figure 4:
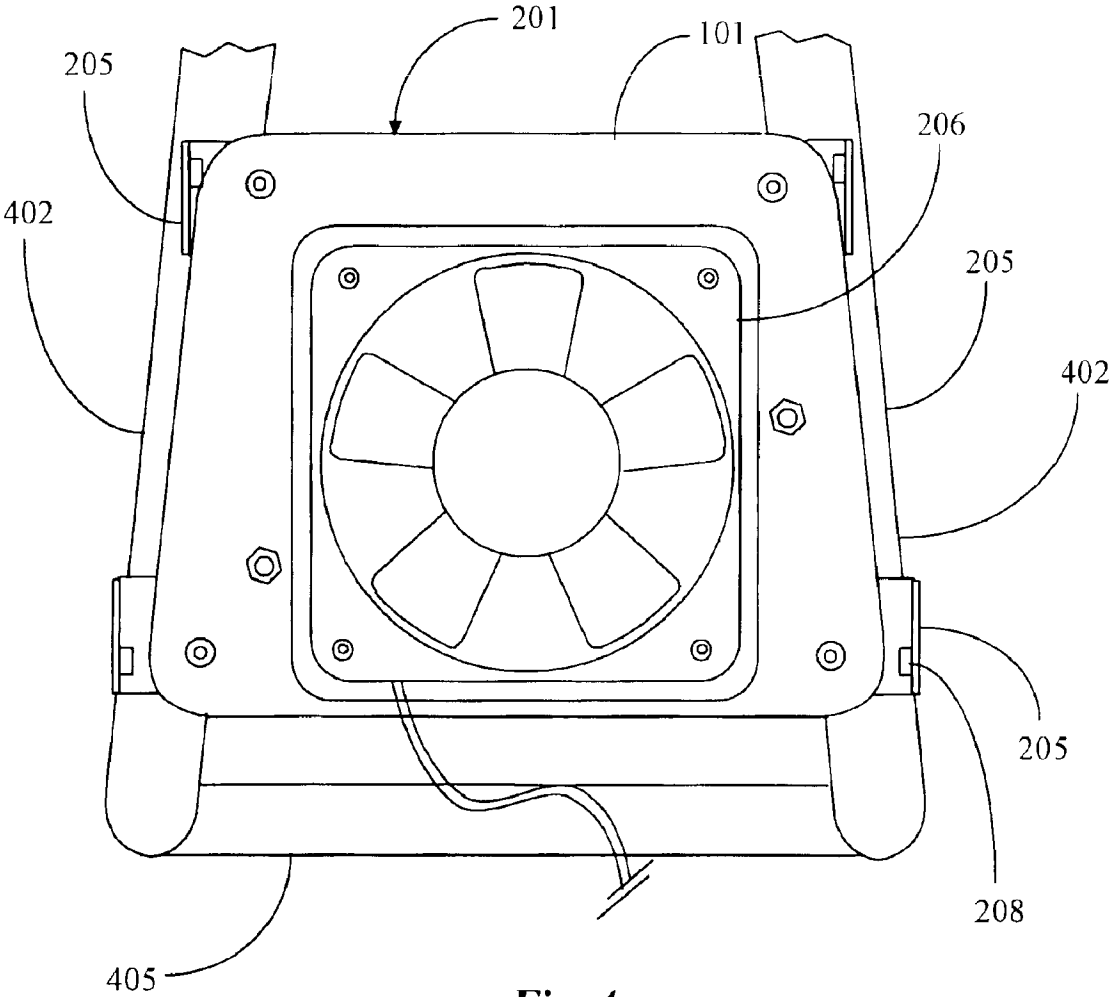
FIG. 4 is an elevation front view of motorcycle frame members and the oil cooling unit of FIG. 2*a* attached thereto.

FIG. 4 is an elevation front view of motorcycle frame members and oil cooling unit 201 of FIG. 2*a* attached thereto, according to an embodiment of the present invention. In this illustration oil cooling unit 201 is shown as it is fixedly attached to down tubes 402 of the front of a frame of a motorcycle, down tubes 402 supported by frame cross member 405. Mounting plate 101 of cooling unit 201 has a mounting bracket 205 affixed at each of the four corners of plate 101 which, when utilized with standard hose clamps or other standard fasteners as previously mentioned, enable the attachment mechanism for oil cooling unit 201.

Cooling fan 206 faces forward in the mounting configuration in the preferred embodiment shown, and when operating, draws air from in front of the fan and circulates it rearward through the opening of body 101, and around and through the multilayered cooling passages of oil cooler 203 (not shown).

Oil cooling unit 201 in one preferred embodiment is provided as an aftermarket kit designed for retrofitting to an existing motorcycle, and all necessary mounting hardware as described above, and any conduits and connectors necessary for making all connections are also preferably provided in the retrofit kit. For some current models of motorcycles of the type described above, the presence of components of the motorcycle which may not readily accommodate mounting of oil cooler unit 201, as shown in FIG. 4, including such as voltage regulator heat sinks, electrical boxes, crank position sensors, and so on, which are typically mounted at or near the front of the frame of the motorcycle, may need to be repositioned in their mounting position to accommodate oil cooling unit 201. In this case an aftermarket oil cooling unit kit may also include all of the necessary hardware for performing such repositioning of existing components of the motorcycle, the kit comprising a different set of components depending on the model of the motorcycle and the application. Oil cooling unit 201 may also be installed to the motorcycle frame, as described above, during manufacture and assembly of the motorcycle.

Figure 5:
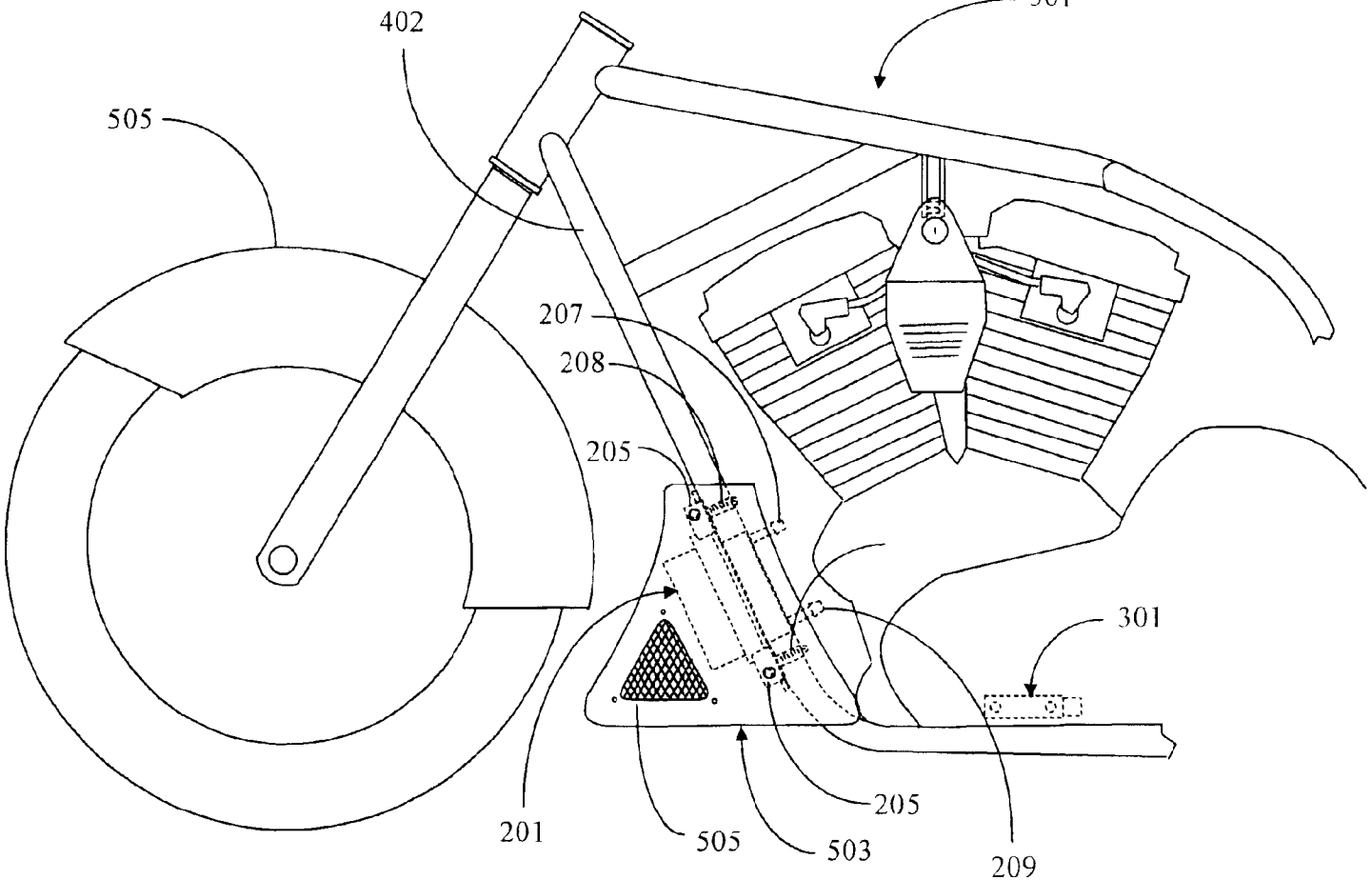
FIG. 5 is a side view of a motorcycle illustrating the oil cooling unit of FIG. 2*a*, and an oil cooler shroud attached to the motorcycle frame according to an embodiment of the present invention.

FIG. 5 is a side view of a motorcycle illustrating oil cooling unit 201 of FIG. 2*a*, and an oil cooler shroud attached to the motorcycle frame according to an embodiment of the present invention. It is the purpose of this simplified illustration to show the mounting positions of oil cooling unit 201 and by-pass valve 301, and to introduce an oil cooler shroud which enhances oil cooling and heat disbursement of the oil cooling unit and engine during operation of the motorcycle, as well as protects components thereof.

Motorcycle 501 represents the type of motorcycle previously described herein which is suitable for application of the oil cooling unit and system of the present invention. Motorcycle 501 has a large displacement, air-cooled four stroke engine with an aluminum engine block, and although in this simplified view many components are not shown for simplicity purposes, it can be assumed that motorcycle 501 has all of said components of such an engine, including an oil crank case, oil pumps, oil filter, and all necessary fittings and conduits for connecting to oil cooling unit 201 and by-pass valve 301.

Oil cooling unit 201 is shown in the hidden view mounted to the angled down tubes 402 of the front of the frame of motorcycle 501, secured to each down tube (only one shown) utilizing mounting bracket 205 and standard hose clamps 208 as described previously with reference to FIG. 4. By virtue of the angle of the set of down tubes, oil cooling unit 201 is angled at approximately 10 degrees from vertical plum.

Oil conduits connecting components of the engine to by-pass valve 301 and oil cooling unit 201 are not shown in this view for purposes of simplicity. The inventor notes, however, that it can be assumed, as will be further detailed in simplified illustrative form below, that there is a conduit connection between output of the oil filter and the supply side inlet of by-pass valve 301, between the supply side outlet of by-pass valve 301 and inlet 207 of oil cooling unit 201, between the return side outlet of by-pass valve 301 and the engine's oil reservoir, and between outlet 207 of oil cooling unit 201 and the return side inlet of by-pass valve 301.

Oil cooler shroud 503 is designed for protecting oil cooling unit 201 and components thereof from damage caused by road debris, tar, and so on, which may be thrown into the air by the front tire of the motorcycle while traveling down the road, or by those of vehicles operating nearby. Oil cooler shroud 503 is also of aerodynamic design, aiding in airflow redirection, optimizing the cooling capacity of the air flowing across and around the engine when maintained forward motion of at least 10 miles per hour. The shroud has screened openings 505 on each side for admitting air to a volume within the shroud, where the air may then be drawn into and urged through the oil cooler radiator by action of the automatically-switched fan.

Figure 6:
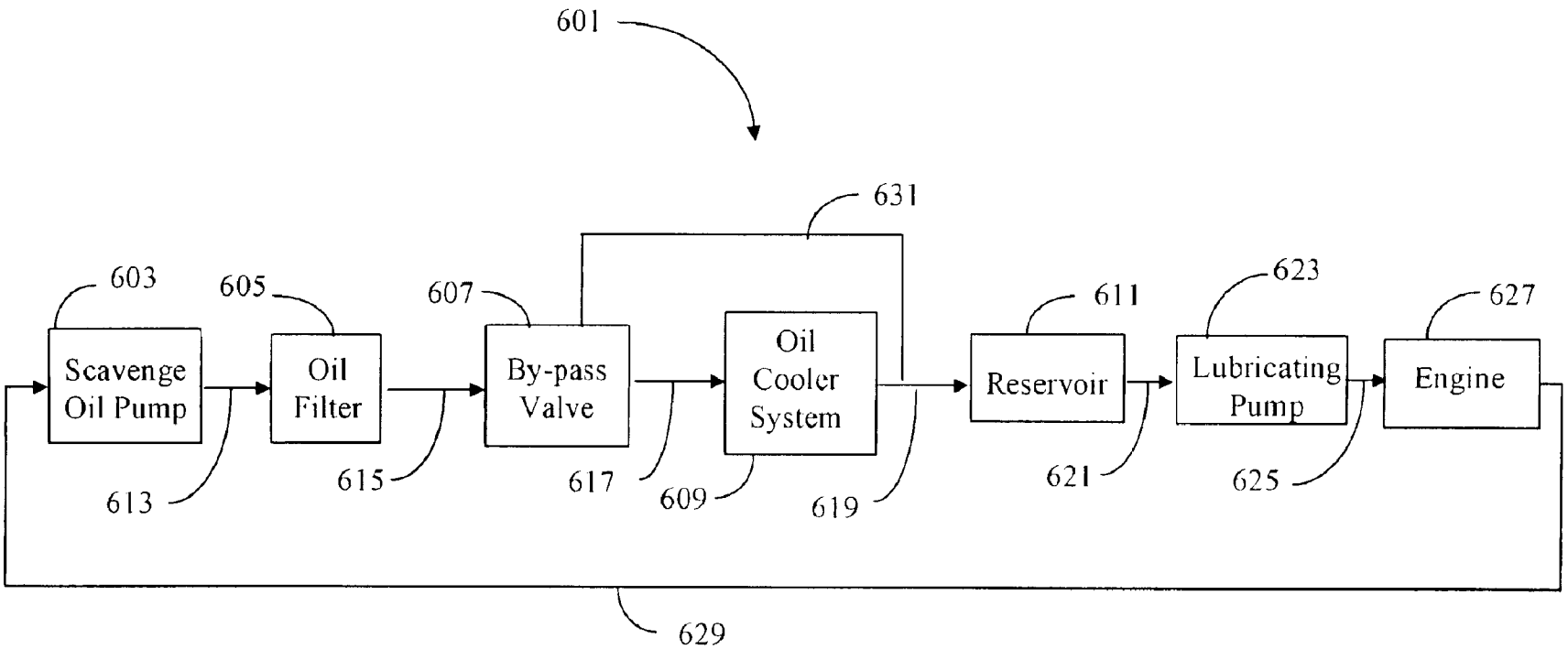
FIG. 6 is a simplified flow diagram of an oil cooling system according to an embodiment of the present invention.

FIG. 6 is a simplified flow diagram showing the oil flow in a motorcycle engine and a cooling system according to an embodiment of the present invention. Scavenge oil pump 603 pumps oil from the engine via path 629 to the oil filter 605 via path 613. Oil passes from the filter to by-pass valve 607 via path 615, and, in the case of oil at a temperature below the lower temperature of a preferred temperature window, oil also bypasses oil cooler system 609 via path 631. As oil temperature rises to the first temperature of the temperature window, the bypass path closes, and all oil from filter 605 must pass through the oil cooler system.

From the oil cooler system oil follows path 619 to reservoir 611, and lubricating pump 623 takes oil via path 621 and urges the oil through lubricating passages of engine 627 via paths 625.

In a preferred embodiment of the invention described herein the oil cooling system is provided as an after-market kit, and may be applied to a wide range of existing motorcycles. This description, however, should not be thought of as a limitation to the invention, as the inventor intends the system for original equipment manufacture (OEM) as well.

It will be apparent to the skilled artisan that there are many alterations that might be made to embodiments described herein without departing from the spirit and scope of the invention. The nature of the radiator, the relative sizes of components, the size of conduits and the style of connectors; all of these characteristics and many more may be changed, and may vary considerably, all within the spirit and scope of the invention. The breadth of the invention is defined only by the claims which follow.

What is claimed is:

1. An oil-cooling system for lubricating oil of a vehicle engine, the system comprising:

a radiator having an oil inlet and an oil outlet communicating with internal passages of the radiator;

an electrically-operated fan interfaced to the radiator in a manner to urge air through the radiator over the internal passages, the fan turned on and off by a temperature sensitive switch sensing oil temperature;

a valve having a first inlet, a first passage through the valve through a first chamber to a first outlet, a second inlet, a second passage through the valve through a second chamber to a second outlet, and a translatable valve closure element controlling a passage from the first chamber to the second chamber; and a temperature-operated translation element positioned in the first chamber in the path of oil entering the valve through the first inlet, and connected to the translatable valve element in a manner to progressively close the passage from the first chamber to the second chamber at higher oil temperature, and to progressively open the passage from the first chamber to the second chamber at lower oil temperature;

characterized in that, below a first oil temperature the passage between the first and the second chamber remains open allowing oil coming in the first inlet to bypass the radiator to the second outlet, the passage closes gradually as oil temperature rises, closes completely at the first oil temperature so that all oil coming in the first inlet must pass through the radiator and none may bypass, and in that the temperature-sensitive switch operating the fan causes the fan to start at a second oil temperature higher than the first oil temperature, enhancing ability of the radiator to cool the oil.

2. The system of claim 1 further comprising a void between the fan and the radiator, providing a positive pressure chamber for air prior to passing over the radiator internal passages, such that air urged by the fan into the positive pressure chamber is distributed evenly over the internal oil passages.

3. The system of claim 1 wherein the radiator comprises a stack-tube design.

4. The system of claim 1 wherein the translatable valve closure element is preloaded in both translation directions by springs of differing spring rate, thereby providing a controlled force bias keeping the valve open at oil temperatures below the first temperature.

5. The system of claim 1 wherein the temperature-operated translation element comprises a volume of temperature-sensitive wax that expands with increasing temperature.

6. The system of claim 1 wherein, at maximum opening of the passage between the first and second chamber, the opening allows at least seventy percent of oil from the vehicle engine to bypass the radiator and return to the vehicle engine.

7. The system of claim 1 wherein, at maximum opening of the passage between the first and second chamber, the opening allows at least ninety percent of oil from the vehicle engine to bypass the radiator and return to the vehicle engine.

8. The system of claim 1 wherein the vehicle engine is a motorcycle engine.

9. The system of claim 1 further comprising a shroud protecting the radiator when mounted on a vehicle.

10. The system of claim 9 further comprising a mounting plate, one or more downtube mounting elements, and connectors and conduits compatible with a motorcycle, thereby providing an aftermarket kit for integrating the system to a motorcycle.

11. A method for managing oil temperature for a vehicle engine, comprising the steps of:

(a) determining a preferred temperature window for oil in operation of the vehicle, comprising a first, lower temperature, and a second, higher temperature;

(b) pumping oil from the vehicle engine to a control valve controlling oil passage into a radiator, and bypassing the radiator via a by-pass passage in the control valve more than seventy-percent of the oil to return to the vehicle engine without passing through the radiator upon cold start-up;

(c) closing the bypass passage at the first oil temperature, forcing all oil entering the control valve to pass through he radiator before returning to the vehicle engine;

(d) starting a forced-air fan at the second temperature to urge ambient air through air passages of the radiator, thereby enhancing ability of the radiator to cool the oil passing through, the fan and the radiator separated by a void providing a positive pressure chamber for air prior to passing over the radiator internal passages, such that air urged by the fan into the positive pressure chamber is distributed evenly over internal oil passages; and (e) as oil temperature falls, opening the bypass passage again at the first temperature.

12. The method of claim 11 wherein the radiator comprises a stack-tube design.

13. The method of claim 11 wherein the temperature-operated translation element comprises a volume of temperature-sensitive wax that expands with increasing temperature.

14. The method of claim 11 wherein, at maximum opening of the passage between the first and second chamber, the opening allows at least seventy percent of oil from the vehicle engine to bypass the radiator and return to the vehicle engine.

15. The method of claim 11 wherein, at maximum opening of the passage between the first and second chamber, the opening allows at least ninety percent of oil from the vehicle engine to bypass the radiator and return to the vehicle engine.

16. The method of claim 11 wherein the vehicle engine is a motorcycle engine.

17. A method for managing oil temperature for a vehicle engine, comprising the steps of:

(a) determining a preferred temperature window for oil in operation of the vehicle, comprising a first, lower temperature, and a second, higher temperature;

(b) pumping oil from the vehicle engine to a control valve controlling oil passage into a radiator, the control valve having a translatable valve closure element preloaded in both translation directions by springs of differing spring rate, thereby providing a controlled force bias keeping the valve open at oil temperatures below the first temperature, and bypassing the radiator via a by-pass passage in the control valve, causing more than seventy-percent of the oil to return to the vehicle engine without passing through the radiator upon cold start-up;

(c) closing the bypass passage at the first oil temperature, forcing all oil entering the control valve to pass through the radiator before returning to the vehicle engine;

(d) starting a forced-air fan at the second temperature to urge ambient air through air passages of the radiator, thereby enhancing ability of the radiator to cool the oil passing through; and (e) as oil temperature falls, opening the bypass passage again at the first temperature.

18. A method for managing oil temperature for a vehicle engine, comprising the steps of:

(a) determining a preferred temperature window for oil in operation of the vehicle, comprising a first, lower temperature, and a second, higher temperature;

(b) pumping oil from the vehicle engine to a control valve controlling oil passage into a radiator having a shroud protecting the radiator when mounted on a vehicle, and bypassing the radiator via a by-pass passage in the control valve more than seventy-percent of the oil to return to the vehicle engine without passing through the radiator upon cold start-up;

(c) closing the bypass passage at the first oil temperature, forcing all oil entering the control valve to pass through he radiator before returning to the vehicle engine;

(d) starting a forced-air fan at the second temperature to urge ambient air through air passages of the radiator, thereby enhancing ability of the radiator to cool the oil passing through; and (e) as oil temperature falls, opening the bypass passage again at the first temperature.

19. The method of claim 18 further comprising a mounting plate, one or more downtube mounting elements, and connectors and conduits compatible with a motorcycle, thereby providing an aftermarket kit for integrating the system to a motorcycle.

* * * * *